US006139209A

United States Patent [19]

Nicol

[11] Patent Number: 6,139,209

[45] Date of Patent: Oct. 31, 2000

[54] SYSTEM FOR BINDING PRINTED WORKS

[76] Inventor: Julien Nicol, 50, rue des Couronnes, Paris, France, 75020

[21] Appl. No.: 08/863,245

[22] Filed: May 27, 1997

Related U.S. Application Data

[63] Continuation of application No. PCT/FR95/01632, Dec. 8, 1995, abandoned.

[30] Foreign Application Priority Data

Dec. 9, 1994 [FR] France ..... 94 14965

[51] Int. Cl.[7] ..... B42F 13/00

[52] U.S. Cl. ..... 402/7; 281/21.1; 281/38; 402/8; 402/19; 402/59; 402/79

[58] Field of Search ..... 402/7, 8, 15, 17, 402/18, 19, 48, 51, 52, 53, 58, 59, 79, 80 R, 80 P; 281/22, 21.1, 15.1, 27.2, 27.3, 28, 34, 36, 38

[56] References Cited

U.S. PATENT DOCUMENTS

| | | | |
|---|---|---|---|
| 1,009,556 | 11/1911 | Palmer . | |
| 1,150,471 | 9/1915 | Wigginton . | |
| 3,224,450 | 12/1965 | Whittemore et al. . | |
| 4,288,170 | 9/1981 | Barber | 402/17 |
| 4,892,335 | 1/1990 | Taft | 283/75 |
| 5,020,830 | 6/1991 | Shishido | 283/101 |
| 5,335,027 | 8/1994 | Lin et al. . | |
| 5,518,787 | 5/1996 | Konkol | 428/43 |
| 5,558,454 | 9/1996 | Owen | 402/79 |
| 5,662,976 | 9/1997 | Popat et al. | 428/40.1 |
| 5,683,194 | 11/1997 | Emmel et al. | 402/79 |

*Primary Examiner*—A. L. Wellington
*Assistant Examiner*—Monica Smith Carter
*Attorney, Agent, or Firm*—Rines and Rines

[57] ABSTRACT

A system for binding printed works consisting of sheets each comprising a first portion for reading and a second portion for binding. Binding is achieved by clamping all the second sheet portions between two reinforcing strips. The first portion of each sheet comprises a data medium 2 with a coating material on both sides thereof forming a data-medium-free strip 3 having a reduced thickness relative to the first sheet portion and a predetermined width that is greater than the width of the reinforcing strips.

15 Claims, 3 Drawing Sheets

SYSTEM FOR BINDING PRINTED WORKS

This is a continuation of international application PCT/FR95/01632, filed Dec. 8, 1995, which designated the United States and is now abandoned.

FIELD OF THE INVENTION

The present invention relates to systems for binding printed works and, more particularly, to those of the type which include a large number of pages and which are intended to be consulted very frequently.

BACKGROUND OF THE INVENTION

In a known manner, large works, such as catalogues, dictionaries, year books, encyclopedias, etc., which are intended to be handled very frequently are bound either permanently, using flexible materials such as paper, fabric, leather or plastics, or such that the pages may be removed, using spiral bindings or files, leading to rapid wear of the pages and/or of the binding of the work.

It has already been proposed, for example in document GB-A-0,597,192, to produce a book, particularly a book for children, in which the printed portion of the sheets is contained in a surface ending a certain distance from one of the edges of the sheet, so as to leave a relatively wide intact margin adjacent to this edge. This margin is perforated with two or more circular holes, extending through the covers and all the sheets of the book and spaced from this edge to receive the fasteners of a file. The sheets of the book are joined together by a thread or by any other fastening means arranged opposite the circular perforations in order to consolidate and reinforce the edge of the book at points opposite the circular perforations.

Also known, from document U.S. Pat. No. 2,706,645, is a book including a body of sheets, flyleaves, a board reinforcement on each side of the sheets which are joined to board cover sheets. Fastenings extend through the body of the sheets, the flyleaves and the board reinforcements. A protective sheath is glued to the outer portion of the board cover sheets, of the join and of the board reinforcements. It extends around the spine of the book and covers over the fastenings. The flyleaves are glued to the inner surface of the board cover sheets and of the joins.

Also known, from document FR-A-2,464,827, is a process for assembling sheets, according to which a flyleaf is placed on top of and underneath a stack of sheets, the stack of sheets is pierced along one of the edges of the stack, spikes formed on a strip of heat-sealable material are inserted into the holes, another band of heat-sealable material, pierced with corresponding holes, is arranged over the spikes, the two strips are pressed together, the second strip is welded over the spikes of the first strip, and a strong cardboard sheet is glued on each flyleaf. The cardboard sheet is of a size which is slightly smaller than that of the surface of the flyleaf left free by the heat-sealable strip so that it can be glued at a sufficient distance from this strip and thus be allowed to pivot freely about its border which faces the heat-sealable strip.

These known processes and devices are unsuitable for printed works containing a large number of pages and, above all, they do not make it possible to protect the sheets of the bound work when the latter is consulted frequently.

SUMMARY OF THE INVENTION

The present invention belongs in this context and its object is to propose a binding system which makes it possible to bind printed works containing, in particular, a large number of sheets, ensuring effective protection for the sheets thus bound so that they can be consulted by a large number of people and also ensuring that, in the vicinity of the binding, the sheets can be read easily.

To this end, the subject of the present invention is a system for binding printed works consisting of sheets each comprising a first portion for reading and a second portion for binding, binding being achieved by clamping all the second sheet portions between two reinforcing strips.

According to the invention, the first portion of each sheet comprises a data medium covered on both its faces with a coating material, and the coating material forms a strip, free from data medium, having a thickness less than that of the first sheet portion and a predetermined width greater than the width of the reinforcing strips.

According to one feature of the invention, the reinforcing strips interact with rods passing through perforations which are regularly distributed along the edge of the second sheet portion.

Preferably, the rods consist of screw rods interacting with nuts, the screw heads and the nuts being located on either side of the reinforcing strips.

According to an advantageous embodiment, the two reinforcing strips are formed from sections each comprising a first flange for gripping the sheets of the work and a second flange for fastening to an item of furniture.

According to another embodiment which is also advantageous, the two reinforcing strips are made in a single piece and are connected by a thinner, flexible central portion.

BRIEF DESCRIPTION OF THE DRAWINGS

Further aims, characteristics and advantages of the present invention will become more apparent from the following description of an embodiment which is given by way of illustration with reference to the appended drawings, in which.

DETAILED DESCRIPTION OF PREFERRED EMBODIMENTS

Figure 1:
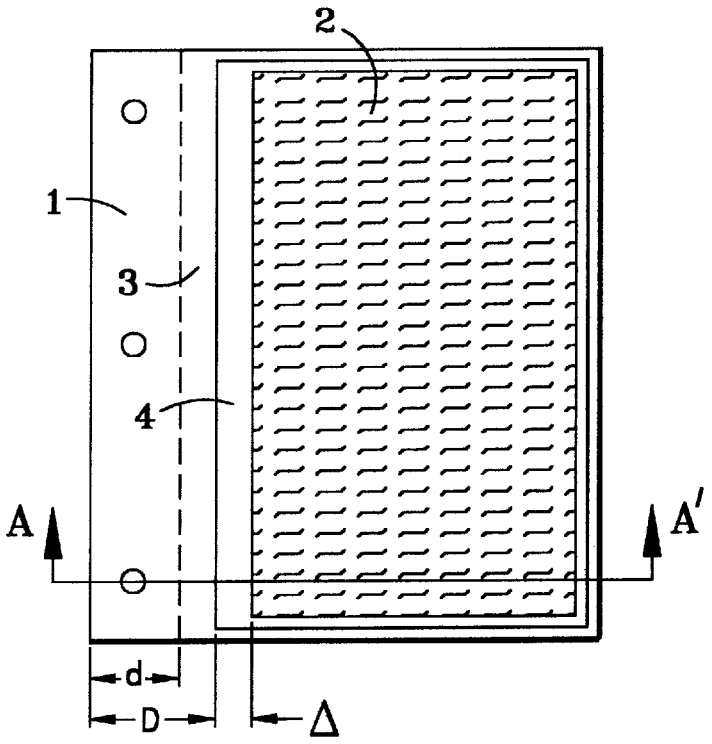
FIG. 1 shows a plan view of a sheet for use in the binding system according to the present invention.
Figure 2:
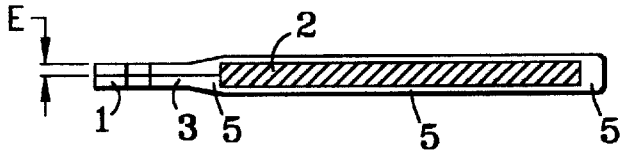
FIG. 2 shows a sectional view of the sheet in FIG. 1, along the line A–A'.

With reference to FIGS. 1 and 2, a sheet for binding according to the binding system of the present invention is shown to comprise a first portion for reading and a second portion for binding. The first portion comprises a data medium 2 consisting, for example, of a sheet of paper printed with text and/or with images. The data medium (or the sheet of paper) 2 itself comprises a margin 4, at least on that side of the sheet which is for binding, of width D, this margin 4 being blank, i.e. free from data.

The sheet of paper 2 is, moreover, covered on both its faces, by means of a process known as plasticizing or encapsulation, with a coating material 5, for example a film 5 of transparent plastic material, which can be used in such processes. A film of this type generally has a thickness E (FIG. 2), for example less than or equal to approximately 75 microns. The cover sheets are produced in the same manner, a board sheet 2' (FIG. 3) being covered on both of its faces by a film 5.

In accordance with the present invention, the dimensions of the film 5 are greater than those of the sheet of paper 2 and of the board sheet 2' on that side of them which is to be bound, the encapsulating transparent film covering upper and lower layers merging and extending to the side beyond the sheet 2, (to the left in FIGS. 1 and 2), so as to provide a strip 3 which has a predetermined width D this strip 3 forming the second sheet portion for binding.

Such a binding is achieved, as, for example, according to the aforesaid document FR-A-2,464,827, by clamping the sheets between two reinforcing strips 7 which have a gripping width d. These reinforcing strips 7 are able to interact with rods 6 which pass through perforations regularly distributed along the edge of the second sheet portion for binding. In the illustrative embodiment shown in the figures, the rods 6 consist of screw rods interacting with nuts, the screw heads and the nuts being located on either side of the reinforcing strips 7. Use may be made of conventional screws, screws of the so-called "tamper-proof" type, or a non-dismantlable assembly, such as rivets.

The sheets of the work, including the two cover sheets, thus each have a strip 3 of width D which has a thickness less than that of the portion for reading and substantially equal to twice that of the coating film, i.e. substantially less than or equal to approximately 150 microns in the example used.

In order to enhance the legibility of the data media 2 in the vicinity of this binding, the width D of the strip 3 is greater, by a predetermined amount, than the width d of the reinforcing strips 7 between which the sheets of the work are gripped.

More specifically, this width D, representing the margin of the sheet to be bound, i.e. the distance between the edge of the sheet of the work and the edge of the data medium 2 or 2', is generally determined approximately by the following formula:

$$D \geqq K[d+\pi/3(NE+a)-M\ ]$$

in which:

K is a constant determined by the mechanical properties of the coating material 5;

a is a constant determined by the thickness of the cover 2';

d is the width of the gripping zone 1;

M is the width of the margin of the data medium 2 (distance between the edge of the data and the edge of the sheet of paper);

N is the number of sheets forming the printed work; and

E is the thickness of the coating material 5.

In the case of the flexible plastic materials used in the plasticizing or encapsulation processes, and the thickness of which is less than or equal to approximately 75 microns, K may be regarded as being very close to 1.

Figure 7:
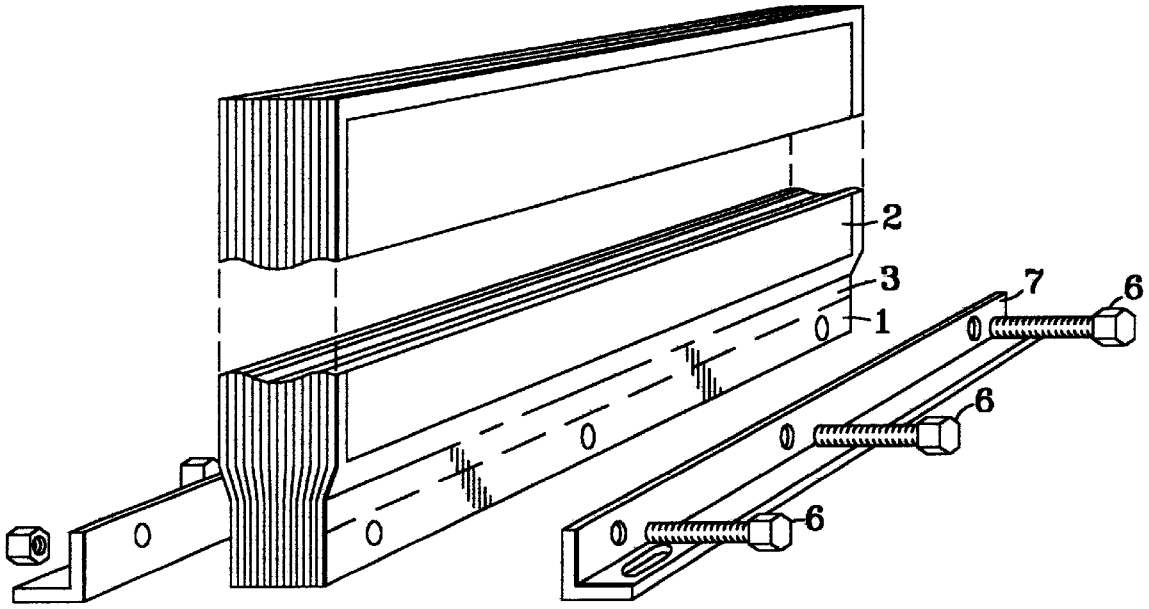
FIG. 7 shows a perspective view of the binding system according to the present invention.

As has been shown in FIG. 7, the sheets for binding are assembled as a stack and then gripped between two reinforcing strips 7 over a width d of the strip 3, so as to leave a strip of width D-d, of maximum flexibility, between the edge of the strips 7 and the edge of the data media 2.

As has been shown in FIGS. 3 to 6, this width D-d, where D is determined by the aforesaid formula, makes it possible to ensure that the pages of the work bound in this way can be read easily and that the work has the necessary flexibility for it to be consulted, even if the said work comprises a large number of sheets.

Figure 3:
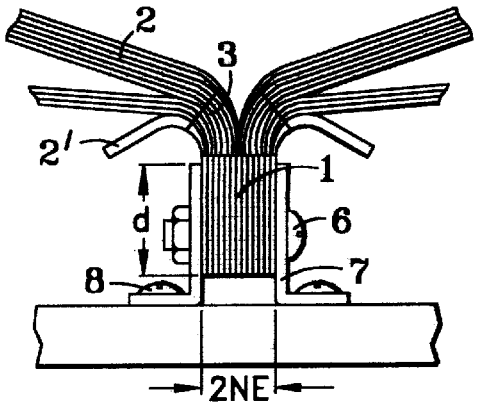
FIG. 3 shows a sectional view of a binding system according to the present invention.
Figure 4:
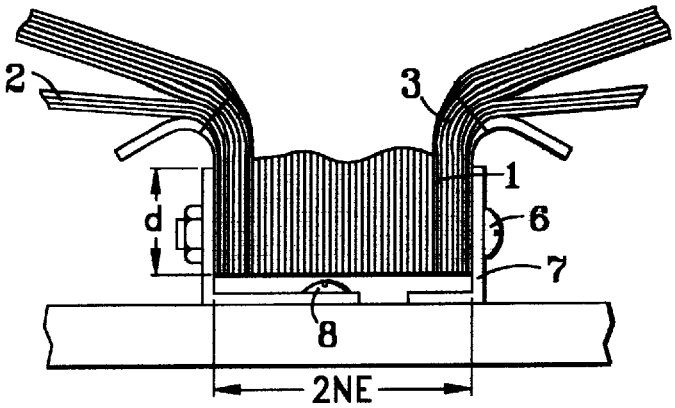
FIG. 4 shows a variant of the binding system in FIG. 3.

In the case of works which are intended to be consulted very frequently by the general public, such as year books or catalogues, provision may be made, as has been shown in FIGS. 3 and 4, to produce the reinforcing strips 7 in the form of sections, for example in the form of right-angled brackets. A first flange of the section is used to grip the sheets of the work, a second flange of the section being fastened with the aid of screws 8 to an item of furniture such as a table, a counter or a desk. These screws may be visible, as in FIG. 3, or concealed, as in FIG. 4, the second flanges facing each other. Such an arrangement has the advantage of preventing the disappearance of works intended for consultation by the general public and, moreover, providing them with a permanent location.

Figure 5:
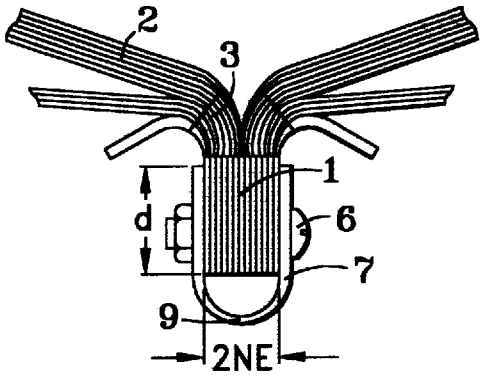
FIG. 5 shows a second variant of the binding system in FIG. 3.
Figure 6:
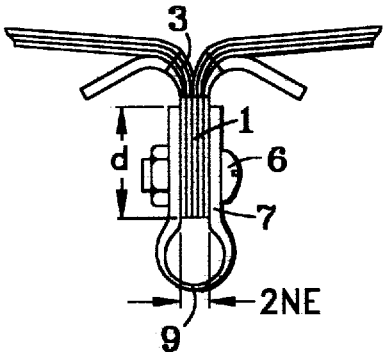
FIG. 6 shows a third variant of the binding system in FIG. 3.

If the latter constraints are less imperative, a binding such as that which has been shown in FIGS. 5 and 6 may be preferred, where the reinforcing strips 7 are produced as a single piece and are connected by a thin, flexible central portion 9 so that they can be used to bind works of different thicknesses.

Moreover, it will be seen that all the sheets bound according to the invention have, between the reinforcing bars 7, a thickness equal to 2*NE, that is to say twice the number N of sheets multiplied by the thickness E of the coating material 5, which is less than the thickness of the rest of the work, in the part for reading, and equal to 2*NE+e, $$\text{with } e=(N-2)*E'+2E''$$

where E' is the thickness of a data medium 2 and where E" is the thickness of a board cover sheet 2'.

It will then be possible advantageously to choose, particularly in the case of the embodiment in FIGS. 5 and 6, reinforcing strips 7 such that their thickness, added to that of the screw heads 6 and of the nuts associated therewith, is less than the value e determined above. The works bound in this way may then easily be stacked on one another without the reinforcing strips preventing them being piled up.

A binding system which makes it possible easily to bind printed works containing, in particular, a large number of sheets has thus been satisfactorily produced in accordance with the present invention. The sheets bound in this way are efficiently protected against soiling and other forms of dirt, and against malicious tearing-out of the sheets of the work bound in this way. Such a work is thus particularly suitable for consultation by a large number of people. Moreover, the invention makes it possible to make the sheets easily readable in the vicinity of the binding, even in the case of works having a very large number of pages.

Of course, the invention is not limited to the embodiments which have been described, but is, on the other hand, capable of being modified in a number of ways which will be apparent to a person skilled in the art.

In particular, provision may be made for the sheets to be secured at the strip 3, free from data medium, by melting the coating material 5 or an added-on meltable material, for example using a laser or other equivalent means.

What I claim is:

1. A system for binding printed sheets having opposing faces, each sheet comprising a first sheet portion containing information for reading and a second contiguous sheet portion for enabling binding and wherein means is provided for clamping all the sheets along said second sheet portion to bind them between two reinforcing strips; and wherein said first sheet portion of each sheet is provided with data for reading except for a blank margin adjacent the second portion, and the sheet is covered over both faces with a transparent coating material extending beyond said margin to form the second contiguous sheet portion and having a thickness less than that of said first sheet portion and a predetermined width greater than the width of said reinforcing strips.

2. The binding system according to claim 1, wherein said reinforcing strips have rods passing through perforations therein distributed along an edge of said second sheet portion.

3. The binding system according to claim 2, wherein said rods consist of screw headed rods with threaded nuts, said screw heads and nuts being located on either side of the reinforcing strips.

4. The binding system according to claim 3, wherein said two reinforcing strips each comprise a first flange for gripping the sheets and a second flange for fastening to an item of furniture.

5. The binding system according to claim 3, wherein the two reinforcing strips are made in a single piece and are connected by a thinner, flexible central portion.

6. The binding system according to claim 1, in which cover board sheets, are provided and wherein said predetermined width D of the coating material is given by the formula:

$$D \geqq K[d+\pi/3(NE+a)-M]$$

in which

K is a constant of substantially;

a is a constant determined by the thickness of the cover;

d is the width of said reinforcing strips;

M is the width of the margin of said data medium;

N is the number of sheets forming the printed work; and

E is the thickness of said coating material.

7. The binding system according to claim 6, wherein the thickness E of said coating material is less than or equal to 75 microns and K is very close to 1.

8. The binding system according to claim 1, wherein the sheets are secured at said second binding portion by melted coating material.

9. A binder system comprising a pair of spaced clampable reinforcing binding strips, a plurality of information-containing sheets-to-be-bound, each having opposing surfaces encapsulated in a transparent plastic material covering extending over both surfaces to provide protection for handling, and extending and merging beyond one side of the sheet to form a contiguous strip of said material to be received between said reinforcing binding strips and to be clamped therebetween together with other sheets.

10. The system as claimed in claim 9 wherein a blank margin is provided on each sheet between the portion of the sheet containing the information-to-be-read and the region of the merging of the encapsulating covering material to said side beyond the sheet.

11. The system as claimed in claim 9 wherein the width of the blank margin is less than the width of said contiguous strip.

12. The system as claimed in claim 11 wherein the width of the blank margin is less than the width of said reinforcing binding strips.

13. The system as claimed in claim 12 wherein the width of said contiguous strip is greater than the width of said reinforcing binding strips.

14. The system as claimed in claim 9 wherein the reinforcing binding strips and the contiguous strips of the sheets are provided with aligned perforations for enabling binding of the sheets between the clampable reinforcing binding strips by clamping rods passed through said aligned perforations.

15. The system as claimed in claim 9 wherein the contiguous strip of the merged encapsulating plastic material is thinner than the encapsulated sheet.

* * * * *